United States Patent [19]

Kurtz

[11] Patent Number: 4,759,885

[45] Date of Patent: Jul. 26, 1988

[54] CONSUMABLE CASE CARTRIDGE

[75] Inventor: Earl F. Kurtz, Denver, Colo.

[73] Assignee: Golden Powder of Texas, Inc., Dallas, Tex.

[21] Appl. No.: 473,974

[22] Filed: Mar. 11, 1983

Related U.S. Application Data

[63] Continuation of Ser. No. 187,534, Sep. 15, 1980, abandoned.

[51] Int. Cl.[4] ..... C06B 21/00

[52] U.S. Cl. ..... 264/3.1; 102/431; 86/1.1

[58] Field of Search ..... 102/431–433; 149/21, 60, 61; 264/3 R; 263/3.1; 86/1.1

[56] References Cited

U.S. PATENT DOCUMENTS

| | | | |
|---|---|---|---|
| 2,632,391 | 3/1953 | Kintzinger . | |
| 3,008,258 | 11/1961 | Johnson . | |
| 3,398,684 | 8/1968 | Kravle . | |
| 3,513,776 | 5/1970 | Driscoll . | |
| 3,558,008 | 4/1972 | Larson . | |
| 3,670,649 | 6/1972 | Hartlein et al. | 102/431 |
| 3,901,153 | 8/1975 | Brabets et al. | 102/433 |
| 3,987,731 | 10/1976 | Brzuskiewicz | 102/431 |

OTHER PUBLICATIONS

*Rocket Propellant Handbook* by Kit et al, 1960, pp. 148–151.

*Primary Examiner*—Harold J. Tudor
*Attorney, Agent, or Firm*—Shoemaker & Mattare, Ltd.

[57] ABSTRACT

A firearm, black powder cartridge for a projectile, including a formed casing of a major quantity of an alkaline nitrate with minor amount of a fibrous, essentially pure cellulose forming a consumable, inflammable case, for containing propelling black powder and holding a projectile. The projectile may be lightly coated with a solid, dry lubricant which is useful for muzzle loading weapons and breech loading weapons. The cartridge produces a minimal of residue which is essentially non-corrosive.

2 Claims, 1 Drawing Sheet

CONSUMABLE CASE CARTRIDGE

This application is a continuation of application Ser. No. 187,534, filed Sept. 15,1980, now abandoned.

This invention relates to a cartridge for a black powder firearms using a cellulose alkaline nitrate inflamable, consumable case containing black powder and secured to a projectile. The cartridge is well suited for muzzle loading firearms, providing a uniform charge, and quick loading for uniform tamping. The cartridge is, also, well suited for breach loading weapons. The invention provides for highly accurate shooting with black powder weapons.

BACKGROUND OF THE INVENTION

Modern firearms generally use cartridges consisting of a metal case containing smokeless powder and holding the projectile. A primer held in the metal case ignites the contained propellant, when struck, to discharge the projectile. Shot-gun shells, use a brass base and a cardboard or plastic tube to hold powder, wads and shot. Neither the cartridges nor the tubes are not consumable and must be ejected after each discharge. Most of these may be used for reloading.

The concept of ammunition which has a consumable casing has had the attention of numerous people including inventors, due to the benefits of lightness, no brass recovery, etc. For example, U.S. Pat. No. 3,513,776 to Driscoll on May 25, 1970, describes a consumable cartridge case formed of carbon filaments embedded in matrix of solid propellant. Kravle in U.S. Pat. No. 3,398,684 of Aug. 27, 1968 described a projectile having its breech end formed with a charge-containing cavity having the walls and bottom lined with nitrocellulose fibers which have a density less than nitrocellulose per se. Johnson in U.S. Pat. No. 3,008,258 of Nov. 14, 1961 teaches a solid propellant formed into a cartridge shape with a primer in the rear end, similar to a brass cartridge. A firearm for such cartridges must specially be made to accommodate the cartridge. Kintzinger in U.S. Pat. No. 2,632,391 of Mar. 24, 1953 suggests a cartridge case made of plastic explosive nitrocellulose. The primer is located adjacent the projectile and exists with the projectile.

Larson, U.S. Pat. No. 3,558,008 provided a consumable case which was threaded on to an adapter and the projectile was threaded onto the adapter. This used a low-nitrogen nitro-cellulose binder for the molded propellant.

In U.S. Pat. No. 3,670,649 Hartlein et al produced a nonmetallic cartridge of fiber-reinforced nitrocellulose having from 0.1 to 3 percent of an organosilicone compound incorporated therein to render the casing impermeable to liquid water. The organosilicone resin is applied by spraying, dipping or brushing to provide a thin coating on the casing.

THE INVENTION

The present invention provides a cellulose-alkaline nitrate wet or pasty mixture formed into a cartridge, pressed or molded into a cup-shape (cartridge) and dried. A propellant is charged into the dried cartridge shaped device, and in one form a ball, with a pregreased wad around a ball, is inserted into the open end. In another form, a molybdenum disulfide (M.D.) coated lead bullet or ball is pressed into the open end of the cartridge The cartridge is fired by an electric or fire spark or a percussion fulminate cap, igniting both the case and propellant. The molybdenum sulfide lubricates the gun barrel leaving a rust preventative coating and discharges residue from an earlier firing. The casing is completely consumed with a minimum of ash, and when a wad is present, it is blown out of the barrel wiping out any previous ash, leaving essentially no residue from the firing in the barrel. For muzzle loading revolvers, the wad and coated ball seals off the mouth of the revolver chamber, thereby effectively preventing double and triple firing, from the fire jumping from chamber to chamber. In this type of gun, the firing is normally from a percussion cap. In another form, the cellulose alkaline cartridge includes a silicone coating to make the case waterproof.

OBJECTS AND ADVANTAGES OF THE INVENTION

Included among the objects and advantages of the invention is to provide a consumable cartridge for a firearm which essentially leaves no residue or waste in the gun barrel in which it is fired.

Another object of the invention is to provide a consumable cartridge for a black powder firearm, which propels a bullet, and is essentially totally consumed in the barrel of the weapon upon firing.

A further object of the invention is to provide consumable cartridges for muzzle loading, black powder weapons, using a consumable case, which provides a uniform powder charge for each shot, and which includes a ball with a pregreased wad.

Still another object of the invention is to provide a cartridge fired by a spark from a fulminate charge, percussion cap or an electric spark.

An additional object of the invention is to provide a cartridge for weapons which does not use brass (or other metal cases) and primers, and which includes a casing of 100% rag paper (cellulose) mixtures, and an oxidizer such as a strong saltpeter solution, formed into a paste, pressed under pressure into cartridge shape, and dried in shape as a consumable, cartridge casing, made waterproof by coating on filming the exterior of the cartridge with a waterproof silicone.

These and other objects and advantages of the invention may be ascertained by reference to the following description and appended drawings.

GENERAL DESCRIPTION OF THE ILLUSTRATIONS

DETAILED DESCRIPTION OF THE DRAWINGS

Figure 1:
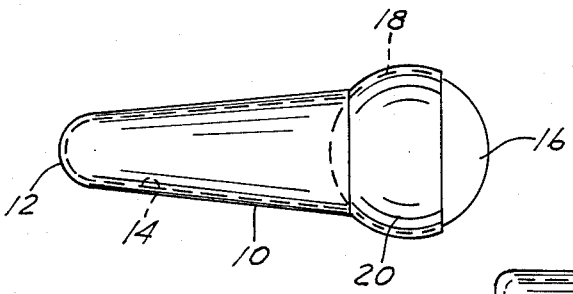
FIG. 1 is plan view of a cartridge, according to the invention, for use in muzzle loading weapons.

In the cartridge of FIG. 1, a combustable case 10 is formed of a molded fibrous cellulose mixed in an aqueous paste of an oxidizer (a nitrate such as ammonium, sodium, potassium nitrate, etc.) molded into shape and dried after molding. The case is generally conically shaped with a rounded end 12 and a hollow chamber 14 for black powder. A ball 16, with a wrap-around wad 18, is enclosed by molded end 20 of the cartridge, which extends around and exceeds the equator of the ball so that the ball is firmly secured in the cartridge.

For one form of a black powder charge, as for muzzle loading weapons, the following ingredients are mixed together in only sufficient water to make a thick paste, which is press molded, and dried in the molded shape:

(a) 100% fibrous cellulose—25 weight percent (b) Potassium nitrate—75 weight percent (c) 1–2 mil coating of Dow-Corning R-4-3117 silicone The cellulose may preferably be fined divided, fibrous cellulose as made by Brown Co., called KS1016 or solk floc. The coating is accomplished by applying liquid silicone—Dow Corning R43117 with catalyst, and when cured water proofs the dired casing. The cellulose is mixed with the aqueous nitrate so as to form a workable paste which may be injection molded, pressure formed, or the like, into the desired shape.

For using the cartridge, it is inserted into the chamber of a front loading revolver, (for example) or the muzzle of a muzzle loader. A ram rod is used to push the cartridge to the breech end of the barrel or the firing chamber, and in so doing the case is crushed and opened. This exposes the powder in the case to a spark from a flint and steel for muzzle loaders, or a percussion cap, etc. A small quantity of dry lubricant, preferably molybdenum disulfide, may be used to coat the ball 16. In some projectiles, grooves are provided in sides for filing with a scrubbing grease, enabling the shooter to add grease to scour the barrel from a previous shot. On firing, the ball, (if coated with M.D.) leaves a minor trace of the molybdenum disulfide on the barrel surface which aids in preventing corrosion. Also, the pregreased wads seal the M.D. coating on the barrel wall as the ball is passing through the barrel. This aids in cleaning the barrel. The powder may be black powder or "Pyrodex". The powder and the case are consumed on firing, and the ball, and ash wad are blown out of the barrel. This leaves a clean barrel, which is lubricated and rust resistant, with a minimum of residue.

In the matter of percussion cap, front loading revolvers, it is imperative to effectively seal the mouth of the cylinder bore, i.e. the end adjacent the muzzle, being fired, to eliminate the danger of multiple ignitions of the other cylinder chambers. This is accomplished by using a pregreased wad or patch 13 (FIG. 7) and slightly oversized ball, so that ignition is mostly completed as the ball enters the muzzle.

The cellulose is preferably fibrous, finely divided (with relatively short fibers) cellulose. Further, a fairly pure cellulose product is preferred (as pure as possible) since it will not contain non-combustible contaminents. The oxidizer is an alkaline nitrate including lithium, potassium, sodium, and ammonium nitrates. The quantity of oxidizer must be sufficient to completely oxidize the quantity of cellulose and the silicone film. A slight excess of the stoichiometric quantity is preferred. The mixture is in a range of from 30–7 weight percent of cellulose and from 70–93 weight percent of the oxidizer. The following are examples of mixtures which may be molded into cartridge shape.

EXAMPLE I 25 weight percent fibrous cellulose, 75 weight percent potassium nitrate. 1 mil coating of a silicone.

EXAMPLE II 15.5 weight percent cellulose, 77.1 weight percent potassium nitrate, 7.4 weight percent of a water base silicone resin (Dow-Corning I-3-5024 water base elatsomer).

EXAMPLE III 14.4 weight percent cellulose, 85.6 weight percent ammonium nitrate.

EXAMPLE IV 8.8 weight percent cellulose, 87 weight percent ammonium cellulose, 4.2 silicone resin (same Example II).

The oxidiation of these combustible mixtures are essentially complete, and the residue is minimal. So long as non-corrosive priming caps are used for the percussion pistols, the only residue in the pistols will be from the black powder. In one series of firings of a Sharp's .45, the barrel only needed cleaning after 50 rounds. The normal procedure is to clean the barrel after 10 rounds of conventional loadings, to obtain top accuracy. With the cartridge of the invention, sufficiently good accuracy of the weapon for hunting is retained after 100 rounds.

The thickness of the combustible material on the wall and butt of cartridge will vary to the usage of the different types of weapons. For instance, the form for a percussion revolver, using a special firing pin arrangement, discussed below, the butt end must be thickend so as to be sturdy enough to act as an anvil for ignition of the fulminate, as well as providing a base to stop a ram rod at a given point so as not to rupture the cartridge. For shotgun shells for a flintlock (or conventional percussion ignition) the base of the shell must be of such a thickness as to allow a rupture and the head of the shell must be able to contain the shot charge without rupture. A breech loader requires that the base be thinner and weaker as to permit the ignition flame to easily penetrate it. For muzzle loading rifles, the cartridge is more flexible, by thinner, walls so that upon ramming the cartridge will not only rupture for ignition purposes, but will act as a gas seal, much in the manner of a patch.

The connection of the projectile to the cartridge may be enhanced by incorporating gripping ridges on the inside of the cartridge mouth, and may be designed to fit the grease grooves of the bullet. Adhesive for the projectile in the cartridge may, also, be used. For caplock revolvers cartridges, the ball will simply snap into place.

Figure 2:
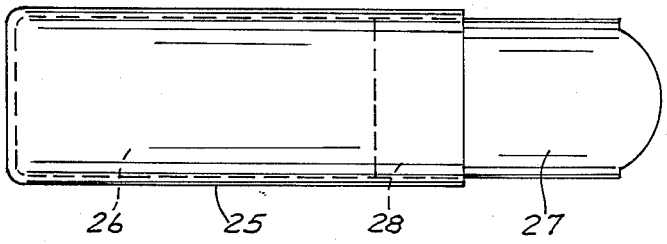
FIG. 2 is a plan view of a modified cartridge, according to the invention, for use in a breech loading firearm.

A cartridge for a weapon with an opening breech is shown in FIG. 2, where a consumable case 25, of a mixture of cellulose-potassium nitrate is molded to shape, and includes a chamber 26 for black powder. A lead ball or bullet 27 (of a wad cutter type) coated with a small amount of molybdenum disulfide (M.D.) if desired, seats in the mouth 28 of the case and is secured therein by known means, or molding the case over the end of the bullet and drying the same.

The cartridge may be inserted into rear of the chamber of a conventional rifle or revolver, altered to remove the firing pin and having two electrodes in place of the pin. A spark across the electrodes, powered by a battery in the grip, ignites the casing and then the propellant to discharge the weapon. The spark initially igniting casing and then the contained powder, propels the bullet out of the muzzle. A bolt action shoulder weapons operates in much the same manner. Where a multiple shot magazine is provided, a round is injected in the barrel on actuating the bolt or other reload device. There is no need, however, for the casing rejection device on opening the barrel breech. Therefore, the cartridge does not require a rim. The bullet, being coated with M.D., dispenses with oil, solvents and lubricants, necessary to clean the barrels of other weapons.

Figure 3:
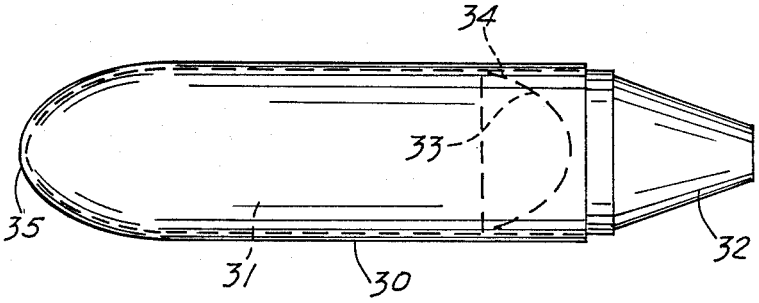
FIG. 3 is a plan view of a modified form of the invention for use with muzzle loading weapons.

A cartridge-projectile arrangement is shown in FIG. 3, using a mini-ball (to expand the bullet wall against the barrel on discharge). The cartridge includes a cellulose-potassium nitrate case 39 having a hollow chamber 31 for powder and bullet 32. The type of nose of the bullet is not critical for the invention. A depression 33 in the rear of the bullet leaves a thin wall 34 which expands, due to the pressure of the explosion, against the gun barrel on discharge. The casing is provided with a round end 55, similar to end 12 of the cartridge of FIG. 1. This arrangement may be provided with square end, as in FIG. 2 for breech loading weapons. The bullet is coated with the M.D. lubricant as before.

Figure 4:
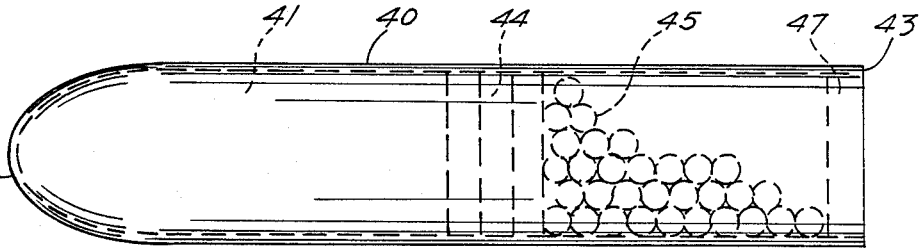
FIG. 4 is a plan view of a shot gun shell in accordance with the invention for muzzle loading weapons.

A shotgun shell, for muzzle loaders, may be made with a consumable case, as shown in FIG. 4. A cellulose-oxidizer case is formed into the shape of a shotgun case 40 with a round end 42 housing a chamber 41 for powder. A set of wads 44 separate powder from pellets 45, and a closing wad 47 closes open end 43 of the case.

Figure 5:
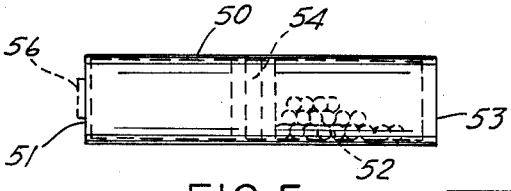
FIG. 5 is a plan view of a modified form of a shot gun shell of the invention.

A cartridge for conventional shotgun firearms, of the rimmed casing type is shown in FIG. 5. A casing 50, of the The self destructing case is composed of fibrous cellulose mixed with aqueous potassium nitrate and molded into form. The casing includes a flat end 51 which may include a fulminate button which is consumable primer 56. The casing includes a powder chamber or cavity with wads 54 separating the shot 52. The open end 53 of the casing is sealed by a wad or the like.

Figure 6:
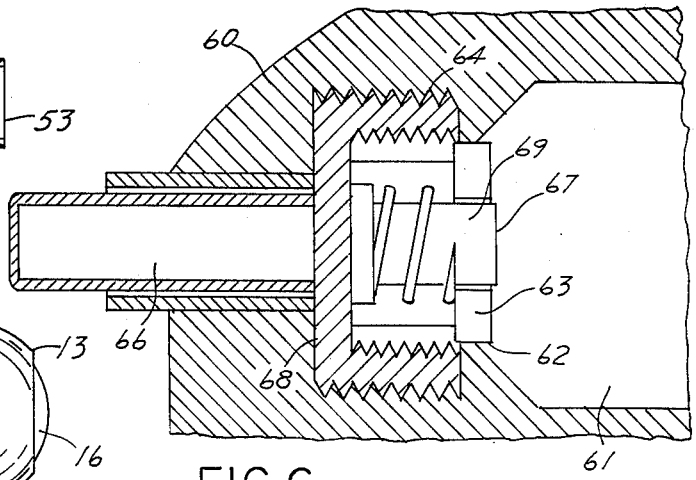
FIG. 6 is a cross-sectional detail of a modification for a precussion revolver providing a firing pin for each chamber of a cartridge holding cylinder.

The modification means for percussion revolvers is shown in FIG. 6. A cylinder 60 with a round chamber 61 is necked down to a threaded opening 62. A recoil plate housing 63 is threaded in the opening. A nipple housing secures the recoil housing into the opening. A firing pin 66, with a blunt end 67 is mounted in the nipple housing being held by a retainer lug 68. A firing pin spring 69 is biased between the recoil plate and nipple housing normally holds the firing pin biased out from chamber 61.

Figure 7:
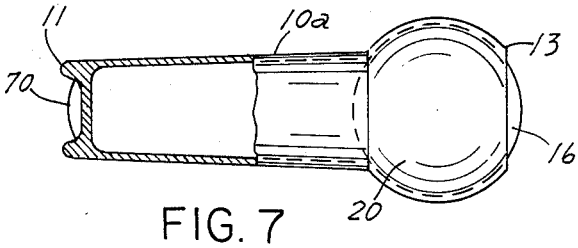
FIG. 7 is a plan view, in partial section of a cartridge and ball for precussion pistols.

A cartridge for such percussion weapons as Colt, Remington, etc, is shown in FIG. 7. The adapter of FIG. 6 may be used to fire the round. A casing **10*a* has an expanded ball end 20 holding a ball 16. The cartridge extends beyond the equator of the ball, and a pregreased rag 13 covers most of the ball. The opposite end of the casing 10*a* has a recessed shaped end 11 holding a fulminate button 70**, which ignites on being struck by the firing pin, with the cartridge acting as an anvil.

The materials for forming the casing may, also, include a relatively minor amount of a flake silicone, such as Dow Corning silicone QE-4-3136 mixed with catalyst XY-181 and mixed with the cellulose-nitrate.

The formulation is arranged to provide substantially total combustion so that the minor quantity of ash and residue will be blown out by the explosion. The silicone coating, is, also, consumed, leaving a minuscule of ash, which is, also, blown out. The silicone coating on the cellulose-oxidizer forms a water proof casing, and the light film coating makes the casing more water proof. The coated surface of casing is, also, slick and easy to handle, sliding into and out of the gun barrel with ease.

What is claimed is:

1. A method of making a consumable cartridge for firearms comprising:

(a) forming an aqueous paste of a major quantity of potassium nitrate and minor quantity of finely divided short fine cellulose fibers, (b) forming a cup-shaped cartridge having an open end and a closed end of said paste under sufficient pressure to produce, after drying, a sufficiently dense, consumable cartridge that is also water-resistant, and (c) drying the formed cartridge, and (d) filling the dry formed cartridge with black powder, and (e) closing the open end of the cartridge with a projectile.

2. A method according to claim 1 wherein said paste is formed 70–93 weight percent of said nitrate and 30–7 weight percent of cellulose fibers together with sufficient water to form a paste.

* * * * *